United States Patent [19]

Stone

[11] Patent Number: 4,727,343

[45] Date of Patent: Feb. 23, 1988

[54] PRECISION TUNING

[75] Inventor: Justin B. Stone, Florence, Mass.

[73] Assignee: Millitech Corporation, S. Deerfield, Mass.

[21] Appl. No.: 912,977

[22] Filed: Sep. 29, 1986

[51] Int. Cl.[4] ..... H01P 7/06

[52] U.S. Cl. ..... 333/232; 333/235; 74/89.15; 74/110

[58] Field of Search ..... 333/209, 224–226, 333/232, 253; 331/107 G, 107 DP

[56] References Cited

U.S. PATENT DOCUMENTS

| | | | |
|---|---|---|---|
| 2,423,461 | 7/1947 | Meahl | 333/224 X |
| 2,503,256 | 4/1950 | Ginzton et al. | 333/232 |
| 2,543,809 | 3/1951 | Sensiper | 333/209 |
| 3,444,486 | 5/1969 | Banes et al. | 333/232 |
| 4,178,562 | 12/1979 | Torma et al. | 333/226 X |
| 4,240,050 | 12/1980 | Powell | 333/253 X |

FOREIGN PATENT DOCUMENTS

| | | | |
|---|---|---|---|
| 525122 | 5/1956 | Canada | 333/253 |

*Primary Examiner*—Paul Gensler
*Attorney, Agent, or Firm*—Charles Hieken

[57] ABSTRACT

A Gunn diode oscillator tuning mechanism includes a waveguide wall formed with a cavity at the outside of the wall for accommodating a tuning mechanism. A tuning rod opening extends between the inside of the waveguide wall and the cavity to snugly accommodate a sapphire rod. A holder carries the fixed end of the sapphire rod and is slidable in the cavity. The holder is formed with a circumferential sectoral slot that engages an annular ring on the rotatable translatable shaft of a micrometer adjacent to the holder seated in a holding plate at the outside of the waveguide wall.

8 Claims, 2 Drawing Figures

PRECISION TUNING

The present invention relates in general to tuning and more particularly concerns novel apparatus and techniques for precision tuning in high frequency electrical circuits, such as in tuning millimeter wave Gunn diode oscillators. The present invention is characterized by precise tuning, reduced cost, reduced breakage of tuning rods, and ease of adjustment.

A typical prior art approach for tuning a Gunn diode oscillator involves moving a sapphire rod across a waveguide channel by rotating the rod, which is threaded or attached to a threaded rod. If the sapphire rod was not straight or perfectly centered in the drive or the constricting hole in the waveguide wall, the sapphire rod would break, making the oscillator inoperative.

It is an important object of this invention to provide an improved high frequency tuning means.

According to the invention, there is housing means comprising a waveguide wall comprising a waveguide for accommodating a tuning assembly free of springs. The tuning assembly comprises rotatable means for rotating and translating shaft means in a direction transverse to the length of the waveguide carrying a first annular element, such as a ridge that also rotates and translates. A tuning rod means having a longitudinal axis defining a tuning direction for tuning energy is said waveguide is seated in a holder slidably mounted in the waveguide wall cavity formed with a second annular element, such as a slot, for mating engagement with the first annular element and carrying the rod for translating movement along said tuning direction through an opening in the waveguide wall into the waveguide between maximum inward and maximum outward fixed positions without tuning rod means rotation. According to a preferred form of the invention, the translatable and rotatable shaft comprises a precision micrometer. The first and second annular elements may be regarded as means for coupling the shaft means to the holder for transmitting translational forces from the shaft means to the holder only along the tuning direction to translate the holder and the tuning rod means along the tuning direction while inhibiting the transmittal of rotational forces from the shaft means to the holder to precisely control the penetration of the tuning rod means through the tuning rod opening.

Figure 1:
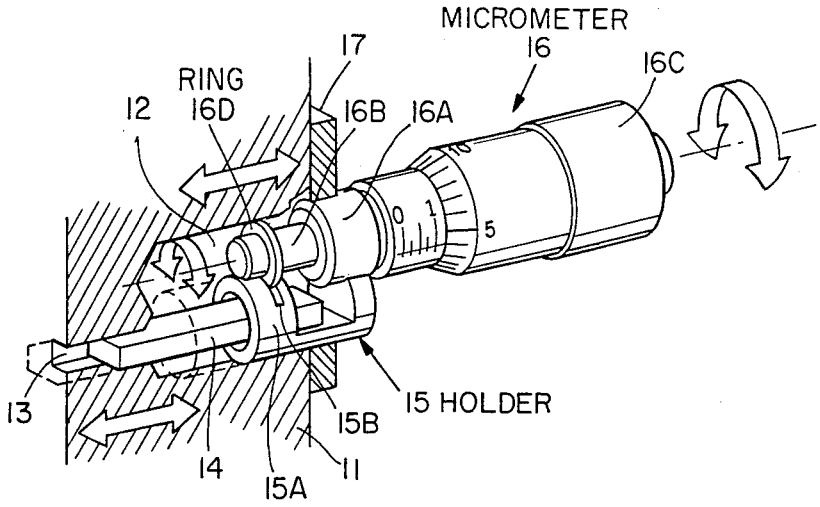
Figure 2:
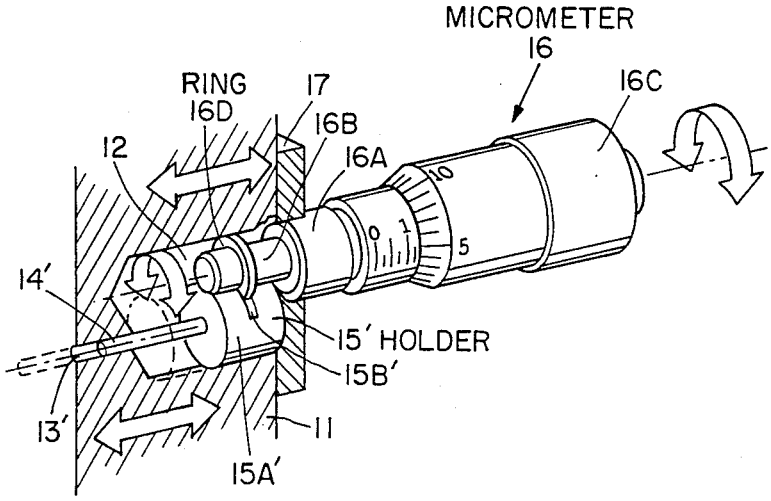

Numerous other features, objects and advantages of the invention will become apparent from the following specification when read in connection with the accompanying drawing in which:

FIG. 1 is a perspective view of an embodiment of the invention with portions cut away to illustrate features of the invention; and FIG. 2 is a perspective view of another embodiment of the invention using a circular sapphire rod.

With reference now to the drawing and more particularly FIG. 1 thereof, there is shown a perspective view of an embodiment of the tuning mechanism according to the invention partially in section. A waveguide wall 11 is formed with a cavity 12 adjacent the outside of wall 11 that communicates with the inside of the waveguide through a rectangular opening 13 through which rectangular sapphire rod 14 may enter the inside of the waveguide. A rod holder 15 carries sapphire rod 14 inside a collar 15A formed with a circumferential slot 15B. A micrometer 16 has an outer annular collar 16A securely fastened to holder plate 17 that is secured to the outside of waveguide wall 11 and formed with an opening coextensive with cavity 12. Micrometer 16 has a central shaft 16B that rotates and translates as knob 16C is rotated. Rod 16B carries an annular ring 16D that rides in slot 15B of collar 15A of holder 15.

Having described the structural arrangement, the mode of operation will be discussed. Rotating knob 16C causes rod 16B to rotate and retract in or extract from collar 16A to correspondingly rotate and translate annular ring 16D. The translation produces forces on the walls of slit 15B to cause holder 15 and rectangular sapphire rod 14 to correspondingly translate without producing rotation of holder 15 or sapphire rod 14. The rectangular opening 13 snugly surrounds sapphire rod 14 to keep rod 14 always perfectly centered and free from rotation while holder 15 receives virtually no twisting torque as annular ring 16B rotates.

By arranging the width of slit 15B to correspond substantially to the thickness of annular ring 16D, there is virtually no backlash, and rotation of knob 16C allows precise control of the position of sapphire rod 14 and the frequency of a Gunn diode oscillator, for example, this position controls. Another feature of the invention resides in the mechanical stops for limiting travel of sapphire rod 14. In the fully extended position the inside edge of collar 15A abuts the inside end of cavity 12. In the fully withdrawn position, the outside of collar 15A abuts the exposed face of collar 16A. The invention thus provides precise alignment free of rotation or wobbling in the holder or alignment hole in the waveguide wall while providing mechanical stops at both ends of travel.

Referring to FIG. 2, there is shown an alternate embodiment of the invention for positioning a sapphire rod 14' through an opening 13' carried by a holder 15'. Corresponding elements are identified by the same reference symbols throughout the drawing. In this embodiment of the invention holder 15' is a circular plug formed with a central opening accommodating sapphire rod 14' and having a circumferential sectoral slit 15B' in which annular ring 16D rides. In the maximally withdrawn position the outside face of holder 15' abuts the inside of holding plate 17. This embodiment of the invention also allows precise alignment without rotating or wobbling of the rod in the holder or alignment hold while providing mechanical stops at both ends.

The invention may also be used to move backshorts such as used in power tuner units. There may be a number of tuning units associated with a single cavity, which may be located in top, bottom, side or end walls.

In a specific embodiment of the invention a suitable micrometer was a Mitutoyo of Japan 148-102, 148-112. While sapphire rods are often used, the tuning rod may be made of other materials, such as, brass, copper, ruby, alumina and other materials.

There has been described novel apparatus and techniques for high frequency tuning which helps prevent rod breakage while maintaining precise tuning, reducing the cost of purchased parts and facilitating assembly. It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. High frequency tuning apparatus free of springs comprising, waveguide wall means comprising a waveguide for guiding electromagnetic energy formed with a cavity for supporting a tuning mechanism and opening to the outside of said waveguide wall means, tuning rod means for tuning high frequency energy within said waveguide and having a longitudinal axis defining a tuning direction, said waveguide wall means being formed with a tuning rod opening extending between said cavity and the inside of said waveguide wall means for snugly accommodating said tuning rod means, holder means slidable in said cavity along said tuning direction for supporting said tuning rod means, rotatable shaft means rotatable and translatable in said cavity for providing tuning control, means for supporting said rotatable and translatable shaft means for rotation and translation in said cavity adjacent to said holder means, and means, free of springs, for coupling said rotatable shaft means to said holder means for transmitting translational forces from said shaft means to said holder means only along said tuning direction to translate said holder means and said tuning rod means along said tuning direction while inhibiting the transmittal of rotational forces from said shaft means to said holder means to precisely control the penetration of said tuning rod means through said tuning rod opening free of backlash.

2. High frequency tuning apparatus in accordance with claim 1 and further comprising, mechanical stop means for restricting the travel of said holder means between fully extended and fully retracted positions.

3. High frequency tuning apparatus in accordance with claim 1 wherein said tuning rod means is a sapphire rod.

4. High frequency tuning apparatus in accordance with claim 2 wherein said tuning rod means is of rectangular cross section and said tuning rod opening is rectangular.

5. High frequency tuning apparatus in accordance with claim 2 wherein said tuning rod means is of circular cross section and said tuning rod opening is of circular cross section.

6. High frequency tuning apparatus in accordance with claim 1 wherein said means for coupling comprises means defining a ridge on one of said rotatable shaft means and said holder means and means defining a slit on the other of said rotatable shaft means and said holder means with the ridge residing in the slit allowing relative rotational movement between the ridge and slit while preventing relative translational motion therebetween.

7. High frequency tuning apparatus in accordance with claim 6 wherein said means defining a ridge is an annular ridge on said shaft rod means and said means defining a slit is a circumferential sectoral slit in said holder means.

8. High frequency tuning apparatus in accordance with claim 7 wherein said shaft means comprises the shaft of a micrometer.

* * * * *